US005460191A

United States Patent [19]

Bonomelli

[11] Patent Number: 5,460,191

[45] Date of Patent: Oct. 24, 1995

[54] DEVICE FOR STRAIGHTENING AND DRYING HAIR

[75] Inventor: Federico Bonomelli, Dolzago, Italy

[73] Assignee: Mako Shark S.r.l., Milan, Italy

[21] Appl. No.: 195,767

[22] Filed: Feb. 14, 1994

[30] Foreign Application Priority Data

Feb. 11, 1993 [IT] Italy ..... MI93U0107

[51] Int. Cl.[6] ..... A45D 7/02; A45D 20/08

[52] U.S. Cl. ..... 132/271; 132/212; 15/77

[58] Field of Search ..... 132/271, 118, 132/212; 15/40, 77; 34/96, 97, 101, 132; 38/101

[56] References Cited

U.S. PATENT DOCUMENTS 2,989,764 6/1961 Peterson ..... 15/77
3,464,425 9/1969 Gagliano ..... 132/212
4,354,292 10/1982 Telestad ..... 15/77

FOREIGN PATENT DOCUMENTS 0263321 9/1987 European Pat. Off. .
2571944 4/1986 France ..... 132/212

*Primary Examiner*—John G. Weiss
*Assistant Examiner*—Elise P. Speaks
*Attorney, Agent, or Firm*—Notaro & Michalos

[57] ABSTRACT

A device for straightening and drying hair uses two facing rotating belts, to which rows of brushes are attached. Air is used at the same time for hair drying. The two belts are moved by two pinions at the same speed but in opposed directions, so that the facing parts of the two belts slide parallely and in the same direction. The rows of brushes have different spacing so that between the facing parts of the upper and lower belts, some brushes are aligned and others are not.

8 Claims, 3 Drawing Sheets

DEVICE FOR STRAIGHTENING AND DRYING HAIR

FIELD AND BACKGROUND OF THE INVENTION

This invention proposes a device for straightening and drying hair.

More precisely, the device according to the invention consists of two plates, around which are many tracks or belts which rotate. The tracks or belts carry brushes and with hair placed, which, between the plates, the hair is straightened and comb. Air diffusion is also used to dry the hair together with the action of said brushes.

At present manual devices are known to straighten hair (straightening plates), which are made up of small pliers, in which at least one of the ribs contains an electric resistance capable of heating its external surface.

By inserting a lock of hair between the plier's ribs and making it slide inside it, starting from the root of the hair and up to its tip, the hair is subjected to a tension which causes it to be straightened, owing also to the pliers high temperature.

By repeating the operation on all the locks of hair a complete straightening is obtained, an operation which must be carried out on perfectly dry hair. It is however apparent how, to carry out the above described operation, it is necessary to employ a person who, after drying the hair, operates the pliers and inserts from time to time the locks into the pliers; these are operations which take a long time and anyway a longer time the thicker is the hair to be straightened.

Another inconvenience of the above described pliers consists in that, even though the operator is skillful, it is impossible to get a perfect result, with perfectly straight and sleek hair.

SUMMARY OF THE INVENTION

The device according to the invention aims at solving said inconveniences by means of the use of two rotating belts, equipped with suited brushes, between which the hair is inserted.

The two belts have the same operating speed but different lengths and the rows of brushes fixed to these belts are spaced out by different amounts between the lower rows different from the distance between the upper rows.

The device according to the invention also foresees a hot air diffuser which dries the hair while this is kept straightened by said brushes fixed to said belts, thus obtaining the straightening of the whole hair at the same time and doing away with any risk of burning the hair.

The hot air flow is preferably directed from the lower plate toward upper plate.

BRIEF DESCRIPTION OF THE DRAWINGS

The device according to the invention will now be further described also referring to the enclosed drawings, in which.

DESCRIPTION OF THE PREFERRED EMBODIMENT

Figure 1:
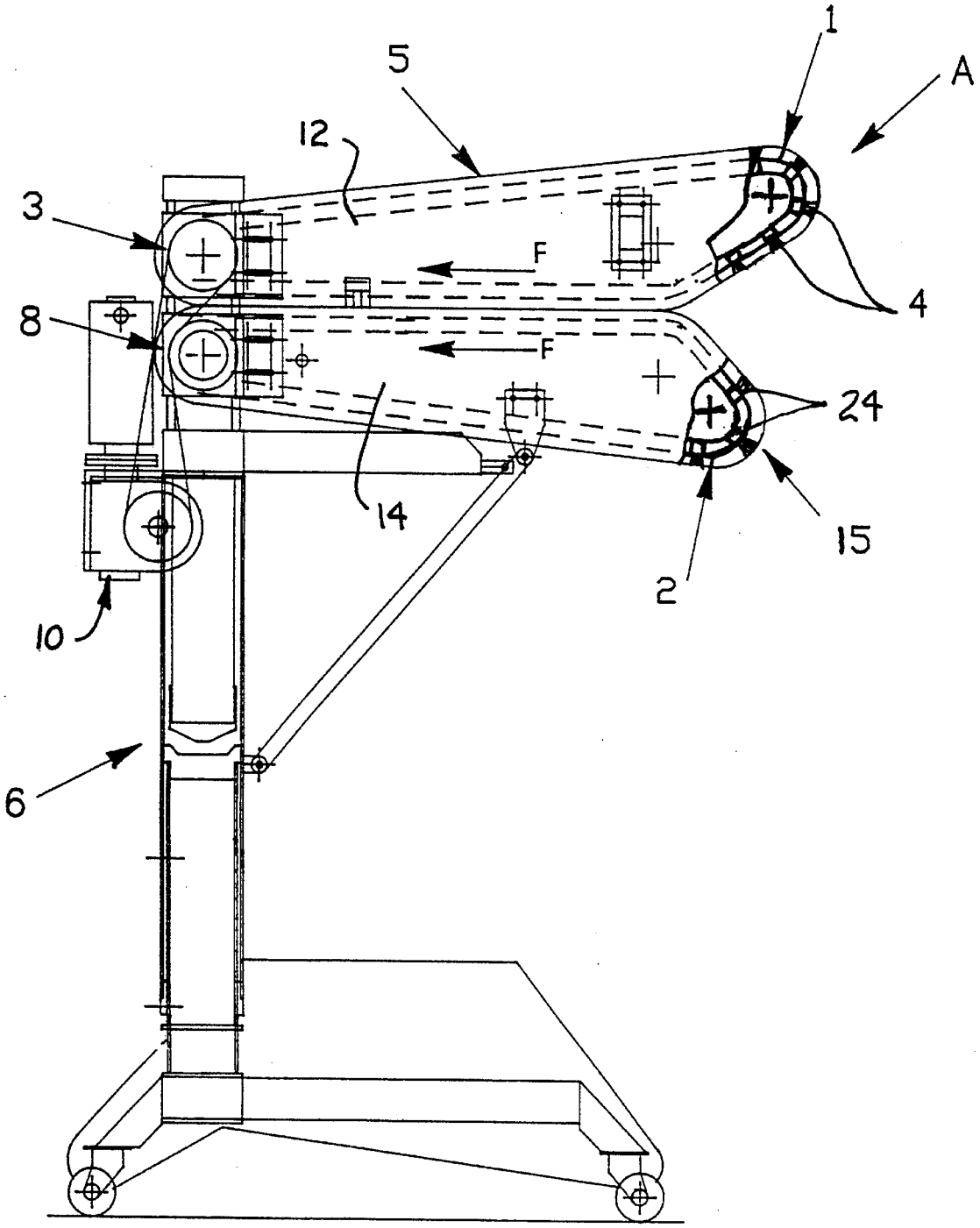
FIG. 1 is a schematic side view, of the device according to the invention with areas broken away to show rows of brushes.

The device comprises a pair of belts 1 and 2, which rotate in opposed directions, in the direction of the arrows F shown in FIG. 1, said belts being operated, through as many pinions 3 and 8, by a gearmotor group 10.

The belts are assembled on as many support plates 12, 14, which force them to follow a path such as the one shown in FIG. 1.

Connected to both belts are plural sets of rows of brushes 4 and 24, with the bristles arranged orthogonally to belts.

Figure 2:
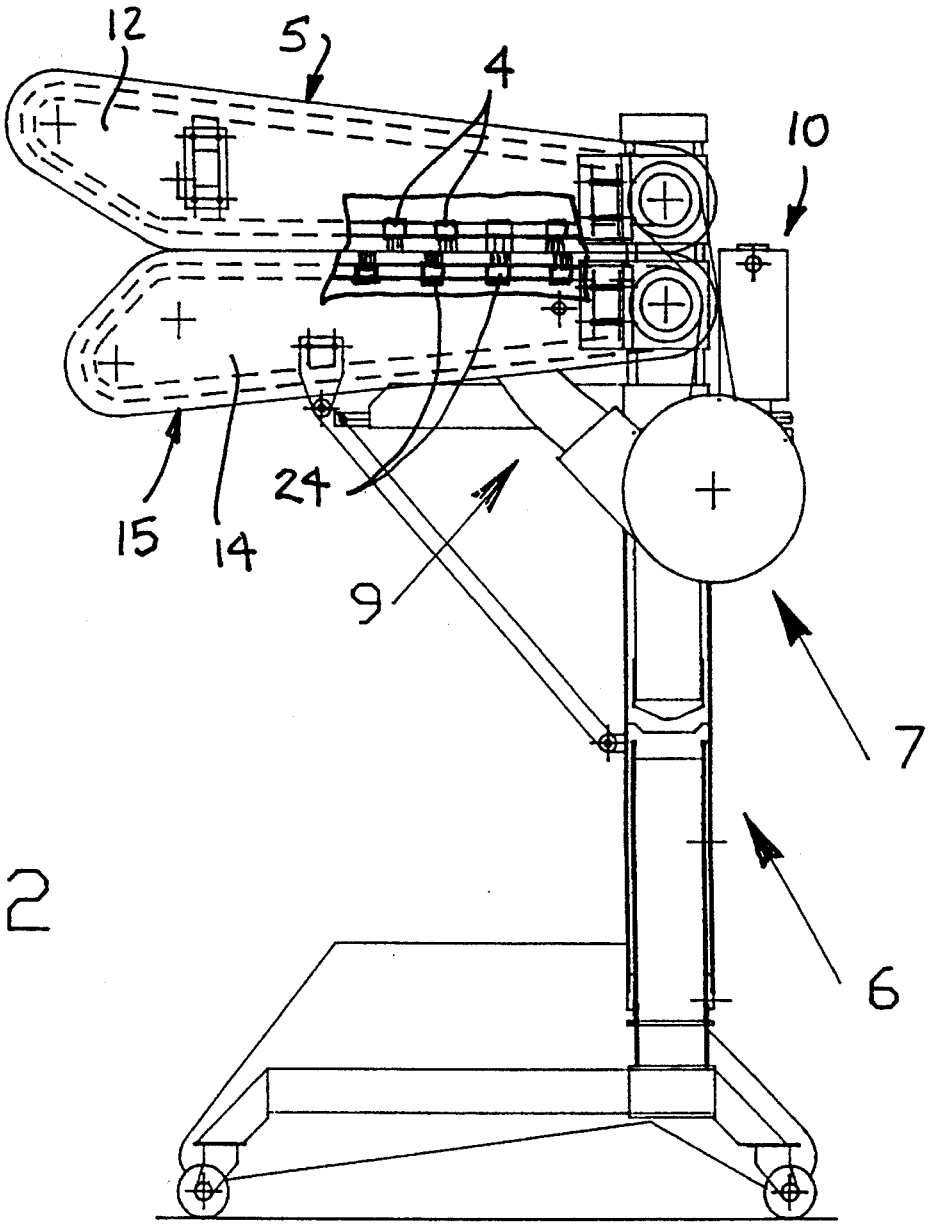
FIG. 2 is a schematic side view of the device from the side opposite to the one of FIG. 1, again with areas broken away.
Figure 3:
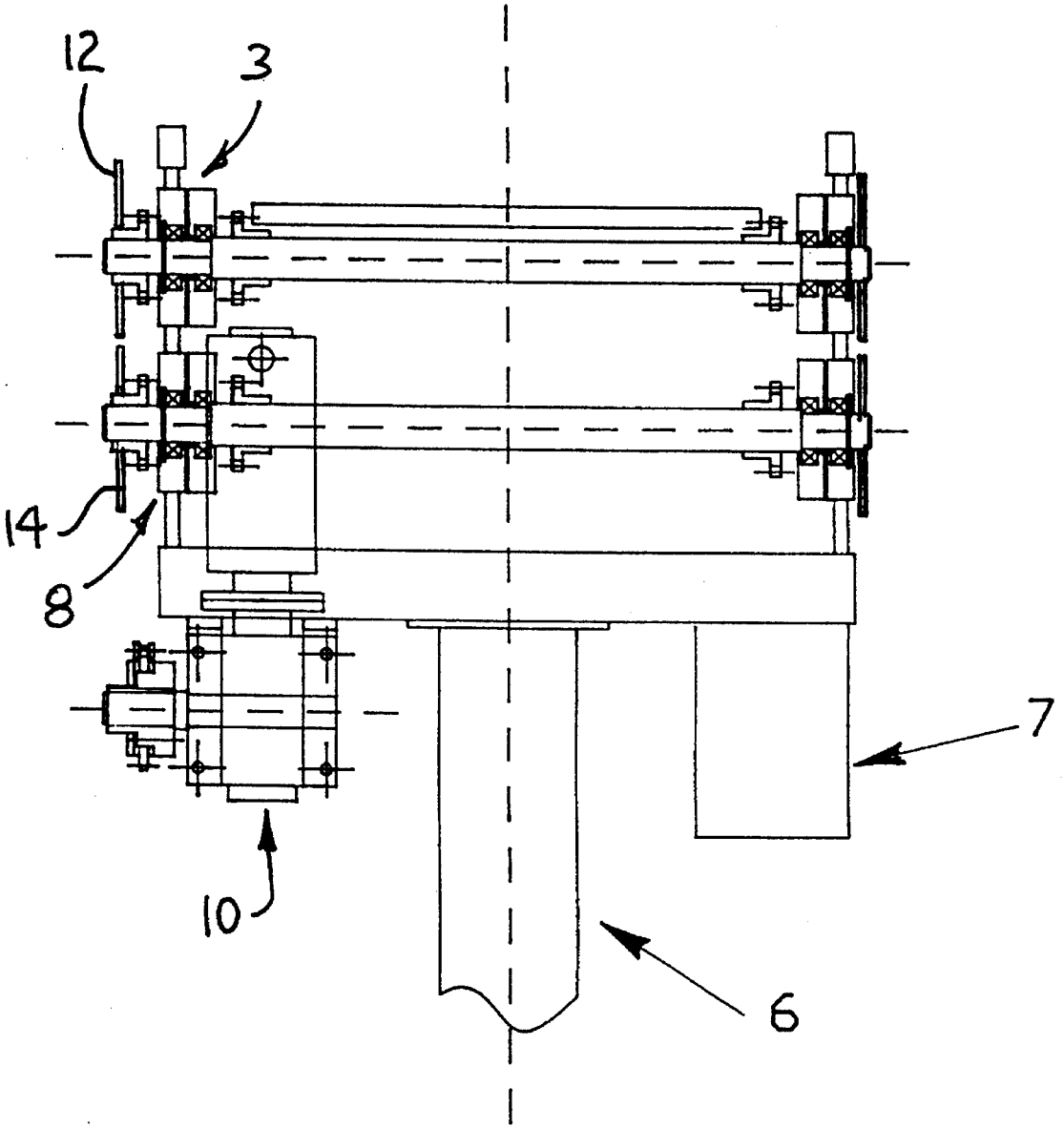
FIG. 3 is a rear view of the device without the rows of brushes.

The two belts have the same operating speed but different lengths, and the brushes fixed to these belts are placed along spaced out rows. A distance between the lower rows of brushes 24 is different from the distance between the upper rows 4 as shown in FIG. 2.

The belt 1 has a housing 5 covering it completely, except its lower part plates 12 are part of housing 5. The same applies to the track or belt 2, with the difference that the only uncovered part in this case is the upper part of housing 15. Plates 14 are part of housing 15.

The plates 12, 14 are hinged to one another so that they can open to allow the hair to be inserted between the belts, which are then closed again to carry out the straightening.

The belt 1 and the housing 5 are pivoted around the axis of the pinion 3 to effect the hinging between plates 12 and 14. This makes it possible to rotate the housing 5 and form a distance between the lower side of the belt 1 and the upper side of the belt 2 in housing 15.

The lower housing 15 provides an attachment for a feed pipe 9 connected to a blower 7; inside the pipe 9 suitable heating means (not shown) are provided.

Preferably the hot air flow is directed in such a way to move from the head of the user towards the rear part of the device in the direction of arrows F (FIG. 1).

The whole device is supported by a supporting member 6 with adjustable height and equipped with wheels so that it can be easily moved and comfortably adjusted.

The working of the device according to the invention will now be easily understandable.

Once the housing 5 of the device is lifted, the device's height is adjusted so that the upper side of the belt 2 is placed in correspondence with the nape of the neck of the person whose hair is meant to be straightened. Then the whole hair is placed on the upper side of said belt 2, which, as previously described, is exposed because the upper art of housing 15 is open. The housing 5 is then lowered by bringing the lower side of the belt 1 in the open bottom of housing 5, in correspondence with the part of the belt 2 on which the hair lies which will thus be shut in. The device is then started.

During operation of the device, some rows of brushes 4 are aligned with rows of brushes 24, and others are not aligned. This is due to the difference in spacing between the upper and lower rows.

When the rows of brushes are alligned the combing action results very strong, while when the rows of brushes are disalligned the combing action is rather weak.

The device simulates in this way a hand combing. The hair is also straightened while the jet of hot air that dries the hair.

After some time, thanks to the action of the brushes and to the hot air jet, the hair is straightened and dry, perfectly sleek.

It is clear how the use of the device according to the invention does away with every risk of burning, since no external hot or incandescent bodies are foreseen; besides, while the device is working, the presence of an operator is not necessary, since he will be engaged only before and after the hair straightening operation.

I claim:

1. A device for straightening and drying hair, comprising:

an upper belt;

an upper row of brushes connected to and spaced along the upper belt;

a lower belt;

a lower row of brushes connected to and spaced along the lower belt, spacing between the upper rows of brushes being different from spacing between the lower rows of brushes;

drive means connected to the upper and lower belts for rotating the upper and lower belts at the same speed with a portion of the upper belt facing a portion of the lower belt so that, with rotation of the upper and lower belts, some of the upper rows of brushes are aligned with some of the lower rows of brushes and others of the upper rows of brushes are not aligned with others of the lower rows of brushes in the facing portions of the upper and lower belts; and means for drying hair which has been placed between the facing portions of the upper and lower belts.

2. A device according to claim 1, wherein the drive means for rotating the upper and lower belts comprises an upper housing with plates for containing the upper belt, with a lower portion of the upper housing being open to expose the facing portion of the upper belt, and a lower housing with plates for containing the lower belt, an upper portion of the lower housing being open for exposing the facing portion of the lower belt.

3. A device according to claim 2, wherein the upper housing is pivotally connected to the lower housing for moving the facing portions of the upper and lower belts away from each other for receiving hair and toward each other for engaging hair between the rows of brushes of the facing portions of the upper and lower belts.

4. A device according to claim 1, wherein the drive means for rotating the upper and lower belts comprise a first pair of pinions engaged to the upper belt for rotating the upper belt in one direction and a second pair of pinions engaged to the lower belt for rotating the lower belt in an opposite direction so that the facing portions of the upper and lower belts move in the same parallel direction.

5. A device according to claim 1, wherein the means for drying hair comprise means for directing a jet of heated air toward hair which is between the facing portions of the upper and lower belts.

6. A device according to claim 5, wherein the means for directing a jet of heated air is positioned so that the jet of heated air is directed in the same direction of movement of the facing portions of the upper and lower belts.

7. A device according to claim 1, including support means connected to the drive means for rotating the upper and lower belts including means for adjusting a height of the facing portions of the upper and lower belt.

8. A device according to claim 7, wherein the support means include wheels for movement of the device.

* * * * *